US010392886B2

(12) United States Patent
Cavalheiro et al.

(10) Patent No.: US 10,392,886 B2
(45) Date of Patent: Aug. 27, 2019

(54) SAFETY MECHANISM FOR INSTALLATION IN SOIL-SAMPLING TOOLING, WITH A SYSTEM FOR BLOCKING THE ESCAPE OF GAS/OIL IN THE STAGE OF RECOVERING THE INTERNAL TUBE CONTAINING THE SPECIMEN

(71) Applicant: SLIM DRILLING SERVICOS DE PERFURACAO S.A., Belo Horizonte-MG (BR)

(72) Inventors: Antonio Sergio Cavalheiro, Belo Horizonte-MG (BR); Mario Cesar Pereira Dos Santos, Belo Horizonte-MG (BR); Leandro Diniz Brandao Rocha, Belo Horizonte-MG (BR); Hamilton Suss Junior, Belo Horizonte-MG (BR); Jose Roberto Scalon Cotello, Belo Horizonte-MG (BR); Ronaldo Soares Eisele, Belo Horizonte-MG (BR)

(73) Assignee: SLIM DRILLING SERVICOS DE PERFURACAO S.A., Belo Horizonte, MG (BR)

( * ) Notice: Subject to any disclaimer, the term of this patent is extended or adjusted under 35 U.S.C. 154(b) by 296 days.

(21) Appl. No.: 15/100,623

(22) PCT Filed: Nov. 28, 2013

(86) PCT No.: PCT/BR2013/000521

§ 371 (c)(1),
(2) Date: May 31, 2016

(87) PCT Pub. No.: WO2015/077850

PCT Pub. Date: Jun. 4, 2015

(65) Prior Publication Data

US 2016/0312558 A1 Oct. 27, 2016

(51) Int. Cl.

| | |
|---|---|
| ***E21B 25/00*** | (2006.01) |
| ***E02D 1/04*** | (2006.01) |
| ***E21B 33/02*** | (2006.01) |
| ***E21B 34/00*** | (2006.01) |

(52) U.S. Cl.
CPC ..... *E21B 25/005* (2013.01); *E02D 1/04* (2013.01); *E21B 33/02* (2013.01); *E21B 34/00* (2013.01); *E21B 2034/002* (2013.01)

(58) Field of Classification Search
CPC ..... E21B 25/00; E21B 25/005; E21B 25/02; E21B 34/00; E21B 33/02; E21B 2034/002; E02D 1/04
See application file for complete search history.

(56) References Cited

U.S. PATENT DOCUMENTS 3,199,907 A * 8/1965 Braun ..... E21B 25/02 294/86.29

* cited by examiner

*Primary Examiner* — Brad Harcourt
(74) *Attorney, Agent, or Firm* — Houtteman Law LLC; Scott Houtteman

(57) ABSTRACT

"SECURITY MECHANISM FOR INSTALLATION IN SOIL DRILLING TOOLS, WITH GAS/OIL LEAKAGE LOCKING SYSTEM ON RECOVERY STAGE OF INTERNAL TUBE CONTAINING TOKEN", where a mechanism for installation on drilling equipment tooling (which uses barrel for the continuous token extraction), be developed with a cable gland assembly (1), connectors (22), (32) and valve (42). With such elements, the mechanism offers a sealing system that prevents, in the recovery step of the inner tube with the token, that there is oil or gas leakages. The mechanism also has an additional safety device (52). Thus, the tooling typically used for ore survey (simpler and cheaper) may be used in wells for gas/oil drilling, bringing remarkable benefits in the segment, both in operationally and commercial level.

7 Claims, 14 Drawing Sheets

Figure 1:
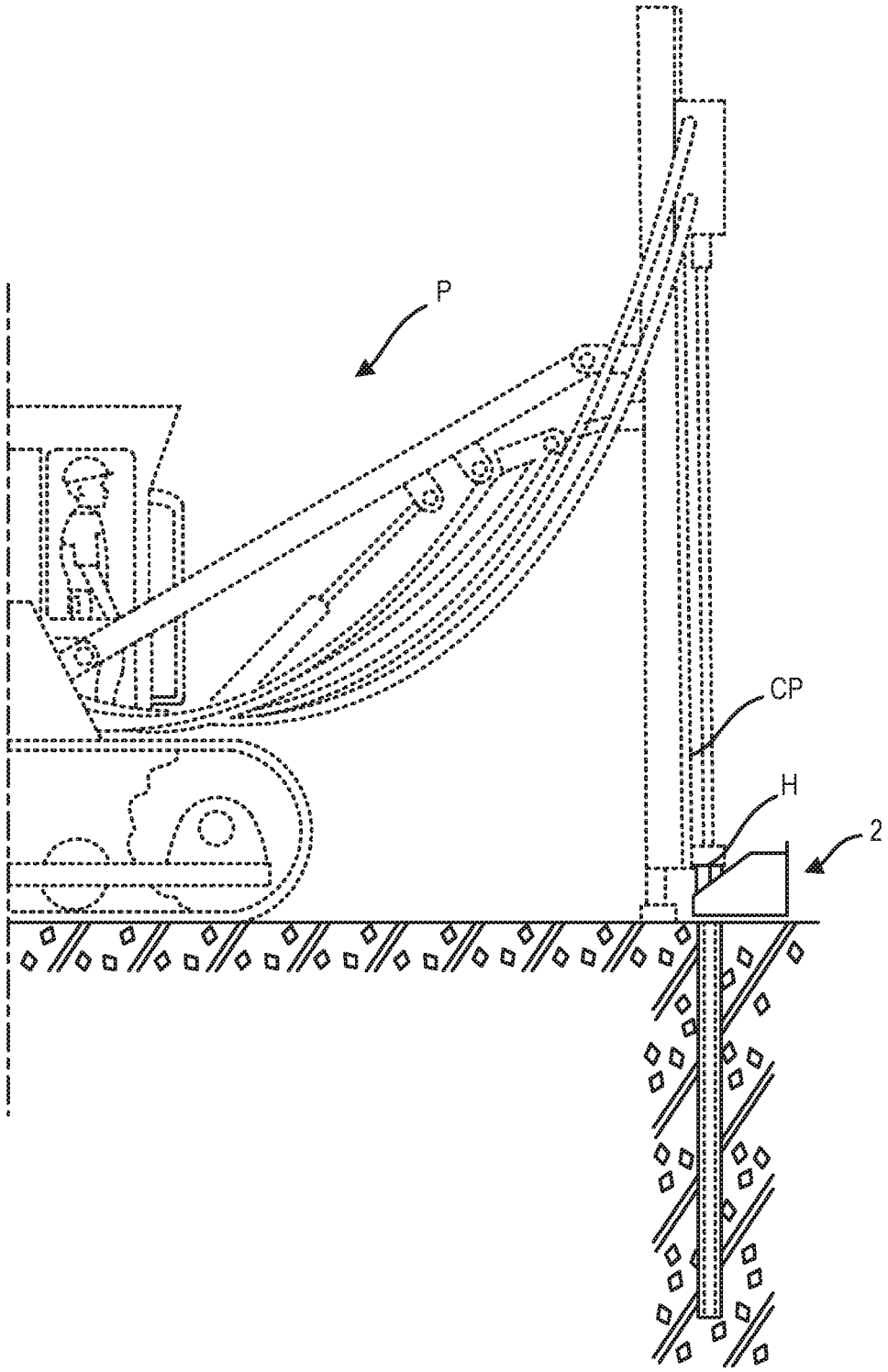

CUT A-A
DET. A
DET. B
C
20
D
19
23
28
42
50
51
B
H
M
17
13
9
5

CUT A-A

CUT A-A

FIG. 16

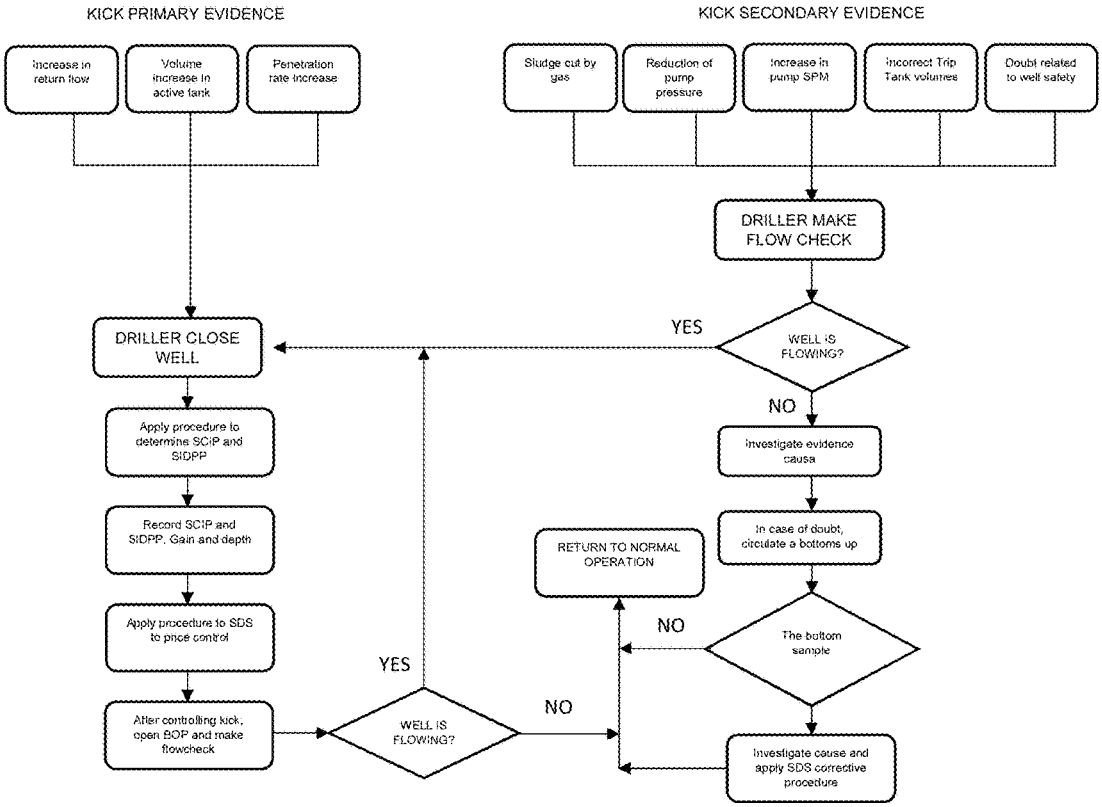

KICK PRIMARY EVIDENCE
Increase in return flow
Volume increase in active tank
Penetration rate increase
DRILLER CLOSE WELL
Apply procedure to determine SCIP and SIDPP
Record SCIP and SIDPP. Gain and depth
After controlling kick, open BOP and make flowcheck
WELL IS FLOWING?
YES / NO
RETURN TO NORMAL OPERATION
KICK SECONDARY EVIDENCE
Sludge cut by gas
Reduction of pump pressure
Increase un pump SPM
Incorrect Trip
Tank volumes
Doubt related to well safety
DRILLER MAKE FLOW CHECK
YES / NO
Investigate evidence causa
In case of doubt, circulate a bottoms up
RETURN TO NORMAL OPERATION
The bottom sample contains HC?
Investigate cause and apply SDS corrective procedure

SAFETY MECHANISM FOR INSTALLATION IN SOIL-SAMPLING TOOLING, WITH A SYSTEM FOR BLOCKING THE ESCAPE OF GAS/OIL IN THE STAGE OF RECOVERING THE INTERNAL TUBE CONTAINING THE SPECIMEN

The present descriptive report refers to a patent application for a mechanism by which, once installed in the soil drilling tools, is formed a gas and/or oil (inflow) leakage locking system at the time of the inner tube recovery of token continuous extraction for the entire working process in gas/oil wells.

STATE OF THE TECHNIQUE

As is well known in the field, soil prospecting through drilling equipment is a process of great importance, since through the results obtained while drilling will be defined large-scale projects for the extraction of ore, gas, oil and other products of industrial use.

In the case of mineral drilling, a system widely used is rotary drilling: briefly, the system is triggered in the prospecting point through the hydraulic motor of one winch, whose head rotates a drilling crown with cutout tool, penetrating into the soil. As the cutout of the rock occurs during the penetration into soil, the crown receives the introduction of rods strings coupled by means of their threaded terminals, coupled by the torque imposed by the turning head of the hydraulic motor.

During the drilling process, the rods are inserted coupled to each other, and, for each inserted rod, a quantity of material named "token" is extracted from the soil layers.

Such material is continuously extracted during the entire work of the drill and is forcibly driven into the barrel, accumulating in billet form. This continuous and uniform extraction of the token is necessary for the detailed study by which the rocky conformations in the drilling point are known.

To remove the barrel in the phase named recovery of inner tube containing token, a boom connected to cables is inserted into the interior of the rods, guided down to the coupling point. When coupled, the barrel—inner tube containing the token is pulled back by cables to the surface.

In this phase of recovery of the internal tube containing token, it is maintained, from the drill, a passage that extends from the drilling point to the surface, which introduction of rods nozzle is exposed in the external environment. This procedure, with the nozzle open, is only made possible in the case of ore drilling, drilling which does not reach the deeper layers of the soil, with low probability of influx risks of gas that may escape around the surface.

In the case of drilling for exploitation of gas/oil, the depths to be reached go far beyond and require the use of a high destructive drilling power drill, which leads to the production of token rock samples in the form of gravel.

The document PI 1001781-0 filed on Jun. 7, 2010 with title "Collector box for drilling token applied in rotating or rotary, hydraulic or pneumatic drillings" shows a collector box adapted in the drilling string nozzle. When air or fluid is injected within the channel of the drill string rods exceeding the drill holes, the debris (token) resulting from the cutout in the soil are conducted to the collector box.

The use of high destructive power drill, in the case of gas/oil wells drilling, does not favor the withdrawal of token in uniform conformation that allow more detailed analysis of the rock formations of the soil. This detailed analysis is needed at certain levels of depth, requiring the use of a drill named crown, which favors this type of uniform extraction of token (in the form of billets). In this case, in gas/oil wells, the tooling must be entirely removed for replacement with a suitable drill, being, then, at each tooling recover operation containing the token, the well closed by means of specific tools. With the drill exchanged for a crown (for coring), the operation is resumed, the well nozzle is re-opened and the tooling re-inserted for this momentary extraction work of more uniform token. This is followed by further withdrawal of the entire tooling containing the appropriate token for analysis, being the well nozzle once again closed with the special tools set for placement of the initial drill, followed by the new opening and new insertion of all the tooling with the original drill for the continuity of the higher destructive power drilling (cutout).

Such procedure is repeated successively during the entire drilling process for the withdrawal of token from the gas/oil well, and, as explained, it is a lengthy process and requires stops in drilling, with withdrawals and reintroductions of the tooling, and drilling string nozzles closures and openings.

All this nozzle closing and opening work during the recovery of the token is required because, in the drilling of the gas/oil well, it may occur the phenomenon named "influx", i.e. the sudden entry of fluids from formation into the well, with the rise of gas or oil through the hole in the soil formed by the drill, which can escape through the drilling string in extremely high pressure, leave through the well nozzle (top of the drilling string) during the recovery of the internal tube containing token and reach the external environment, with the risk of causing serious accidents.

As noted, the drill in gas/oil drilling is more complex, especially in relation to the stage of extraction of the token, because of the possibility of influx incidence.

Therefore, it is not currently possible to simply use the tools of the ore drilling (much simpler and cheaper) in oil/gas drilling tooling (more robust and expensive).

PURPOSE OF THE PATENT

This is precisely the aim of the concerned mechanism, reason for this patent application, which was developed for the installation in a soil drilling tooling and which, by its constructiveness, enables a oil and gas leak lock system in the phase of extraction and recovery of the internal tube containing token, made by barrel.

The mechanism works with four distinct sets, being a cable gland, a "Y" connection, a false swivel connector and a safety valve, all coupled between themselves. The mechanism is threaded into the drill string nozzle at the moment of the recap of the tube containing the token of the rock, and will offer, therefore, a security system whereby the ore drilling tooling (simpler and less costly) may be used for gas/oil wells drilling, thus bringing enormous functional and commercial benefits.

Explained superficially, the mechanism, its installation and the security system that it involves are now better detailed through the attached drawings.

FIG. 1 shows the state of technique, from which was extracted the image of the referred P1 1001781-0.

Figure 2:
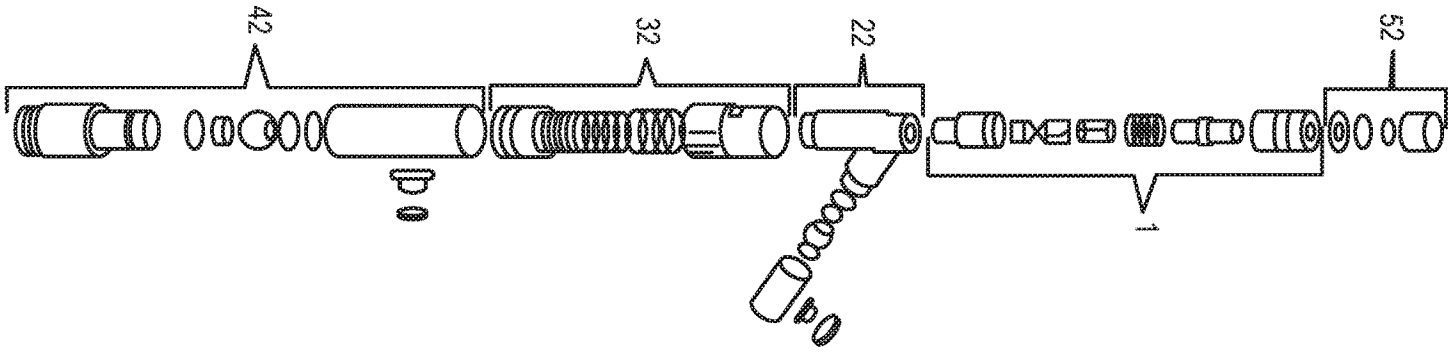
Figure 3:
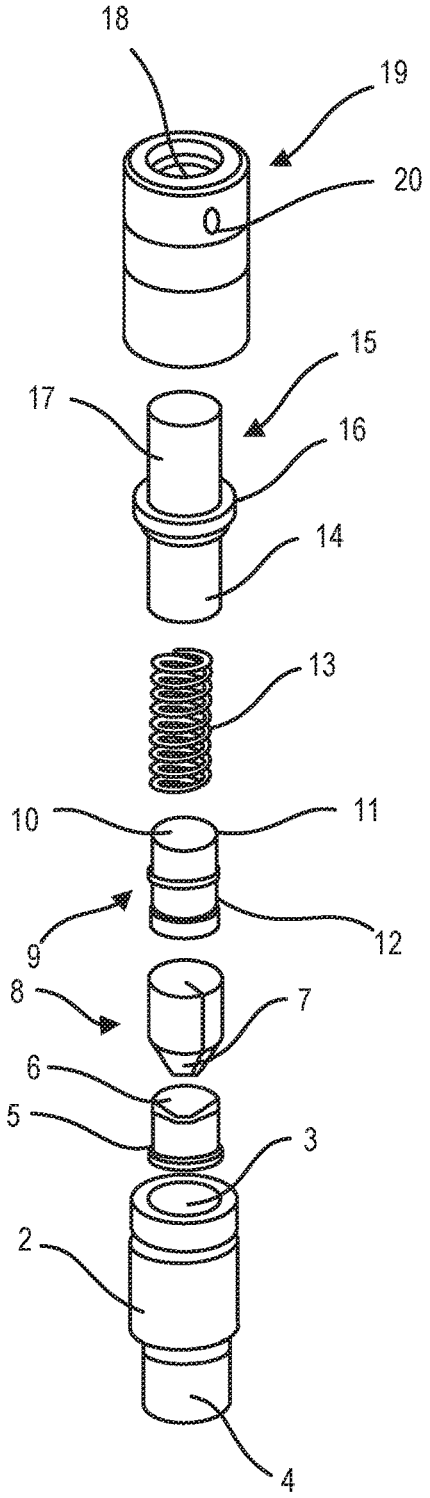
Figure 4:
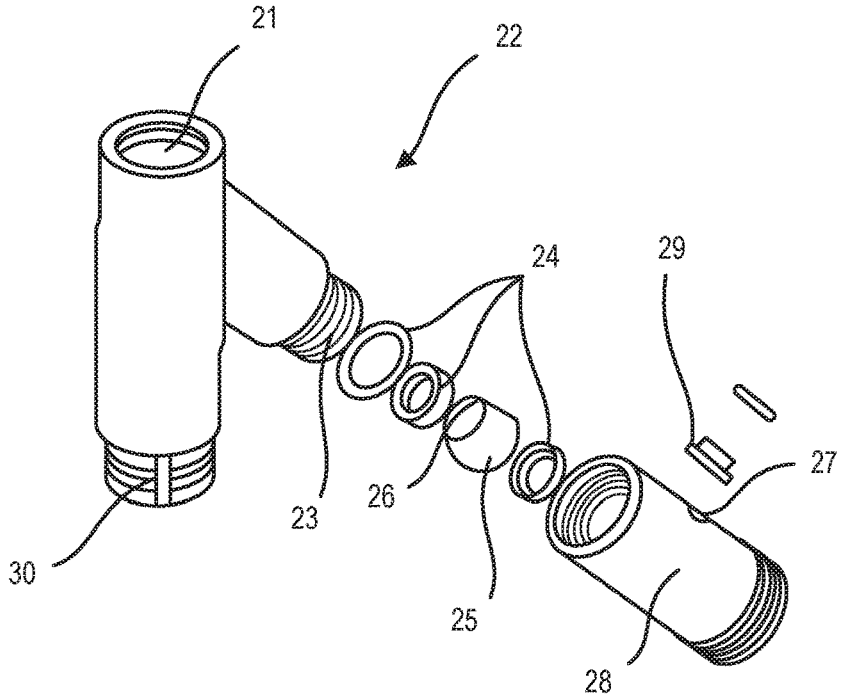
Figure 5:
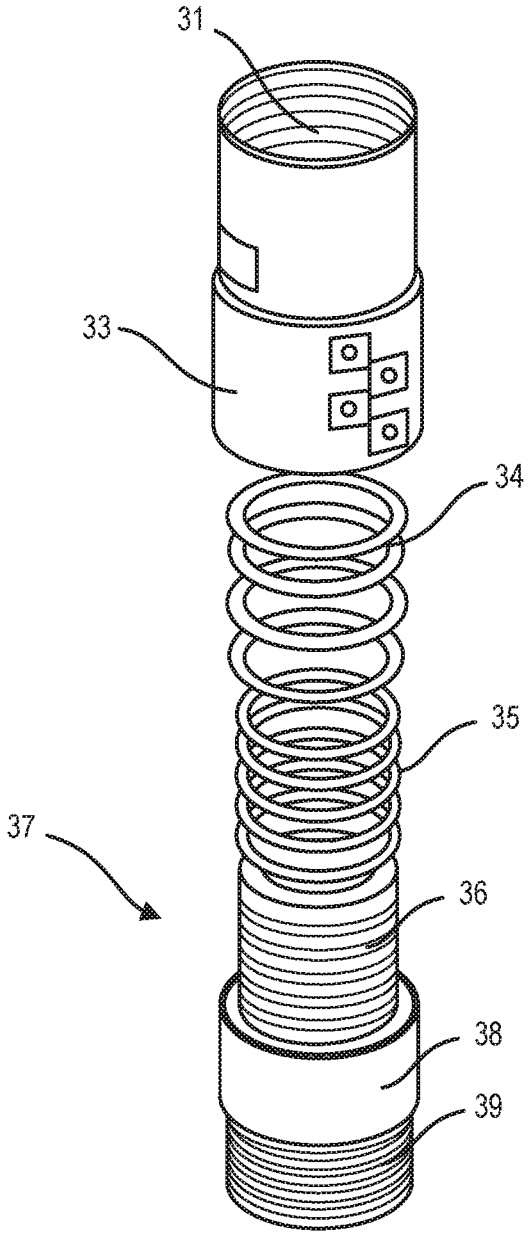
Figure 6:
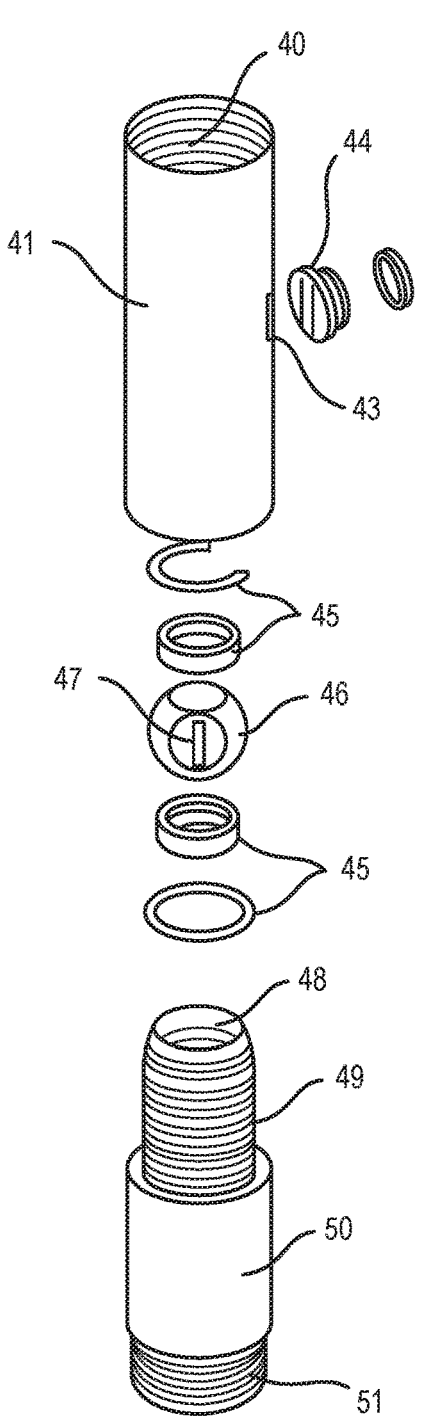
Figure 7:
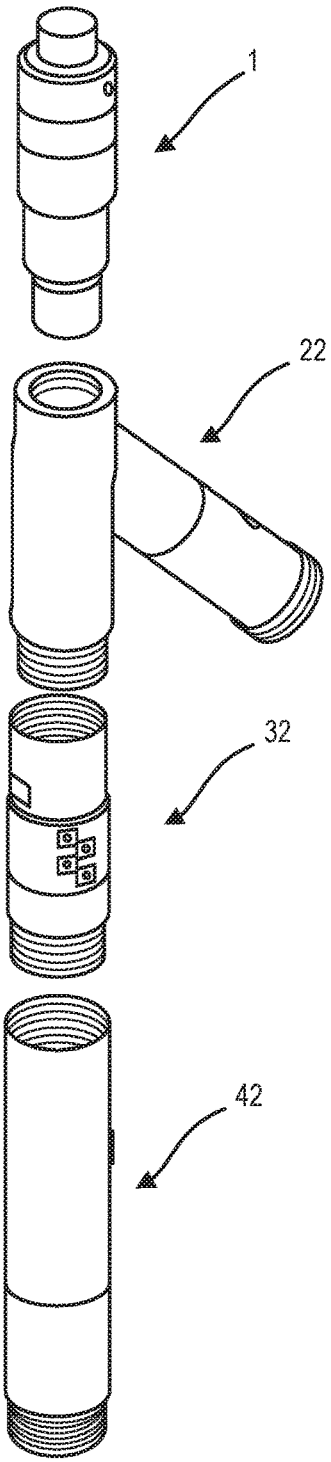
Figure 7A:
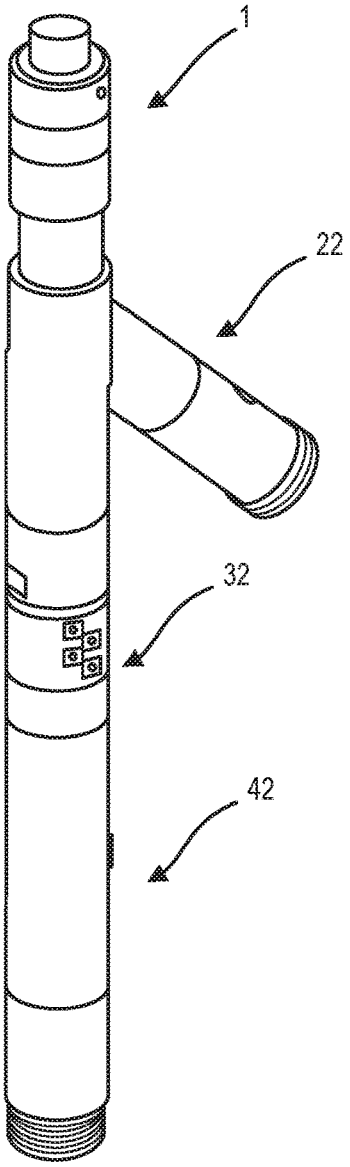
Figure 8:
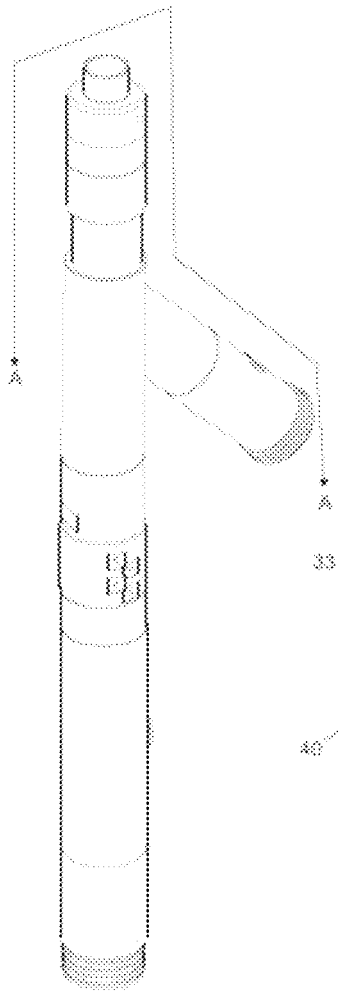
Figure 8A:
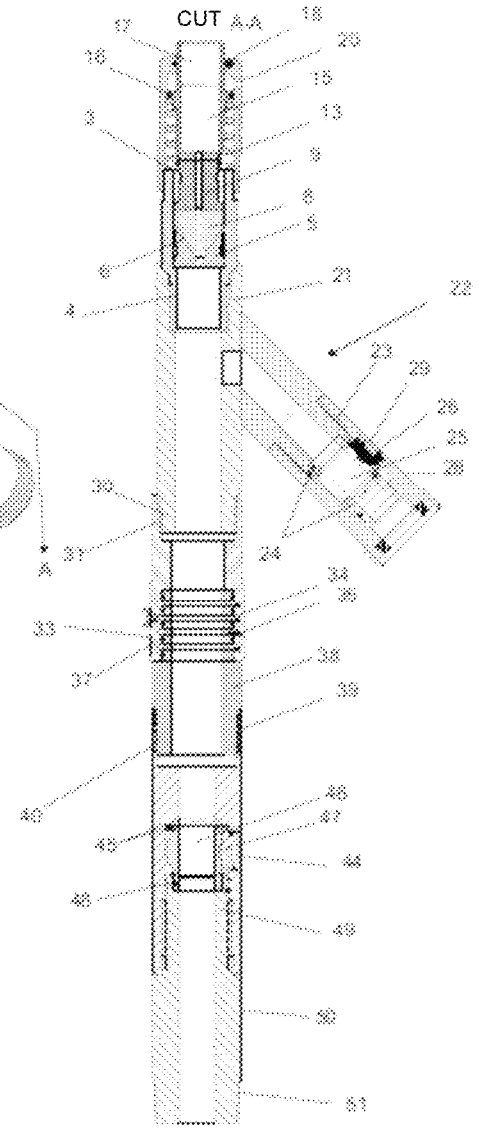
Figure 9:
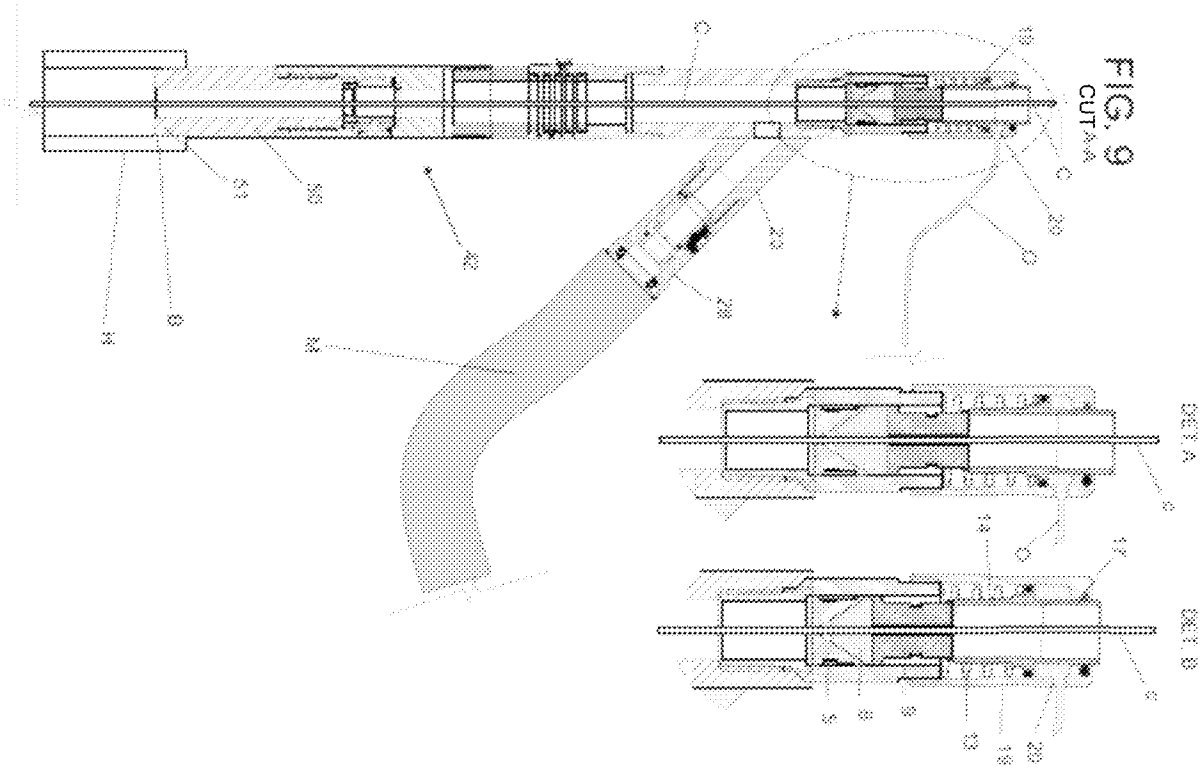
Figure 10:
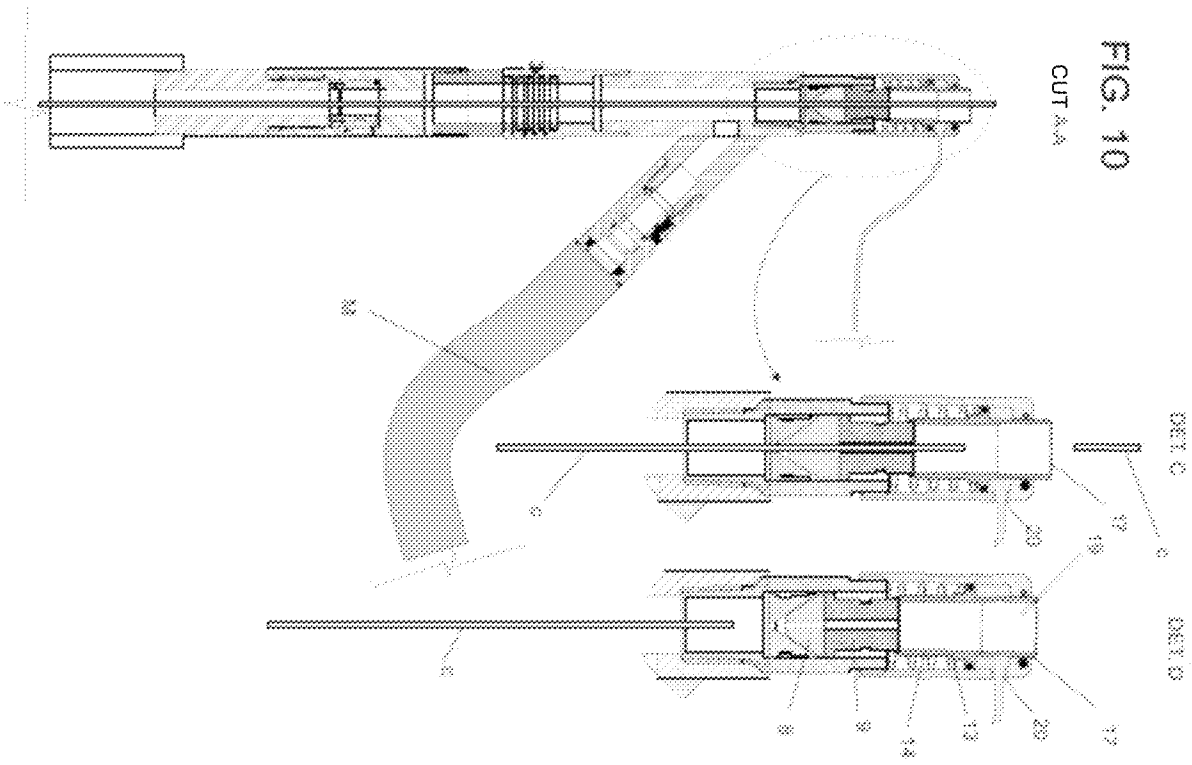
Figure 11:
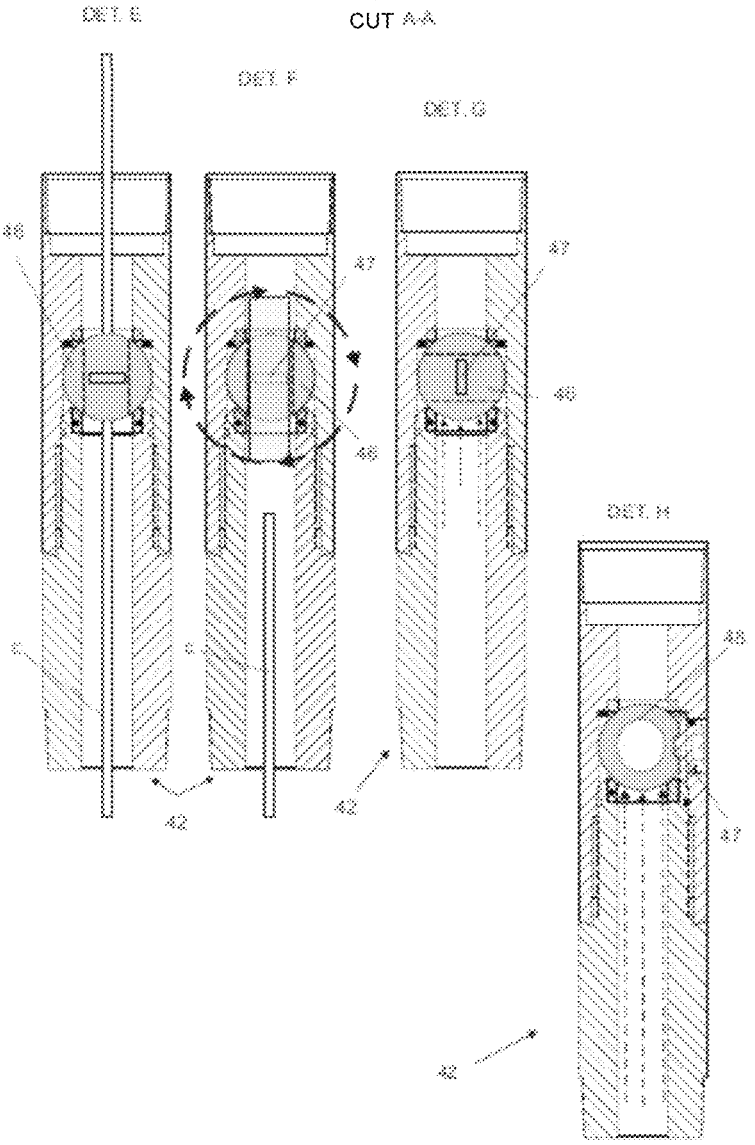
Figure 12:
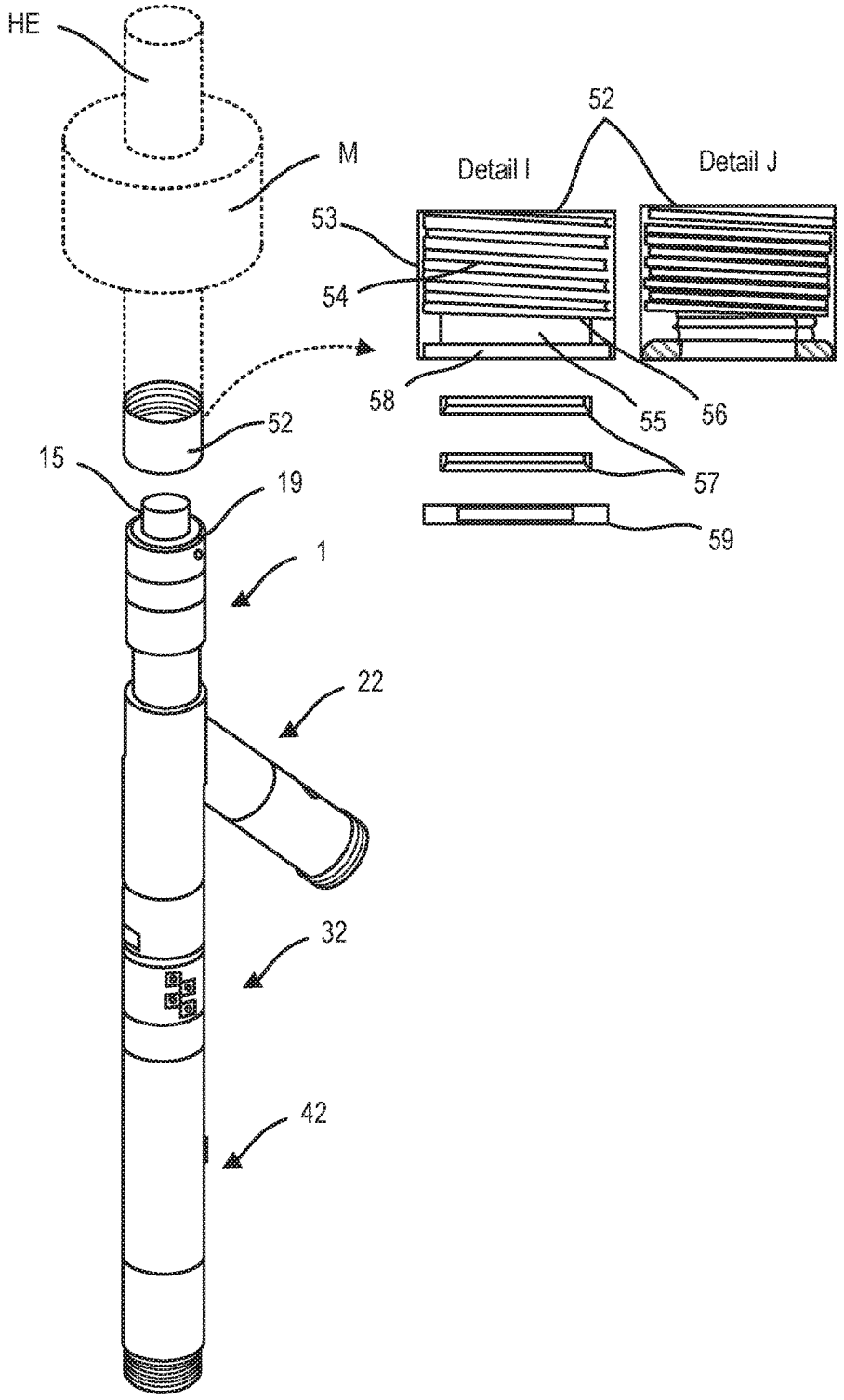
Figure 13:
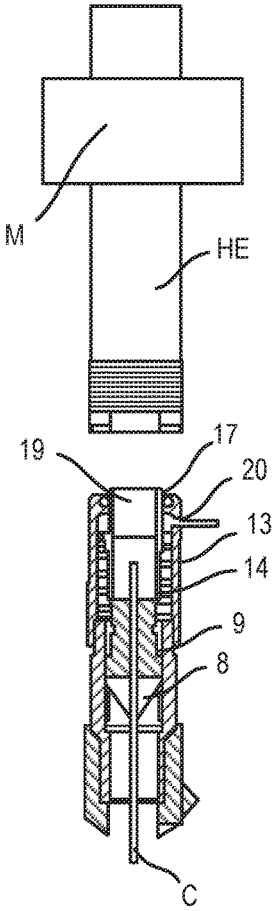
Figure 14:
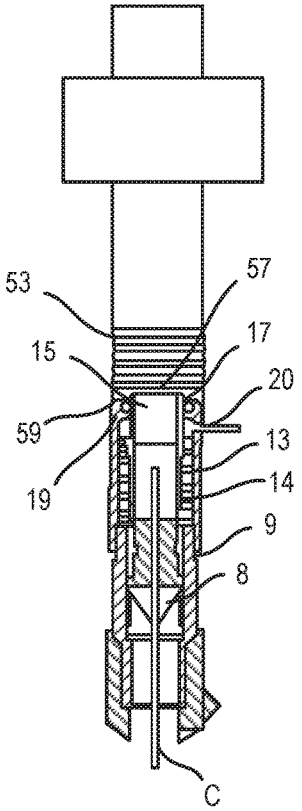
Figure 15:
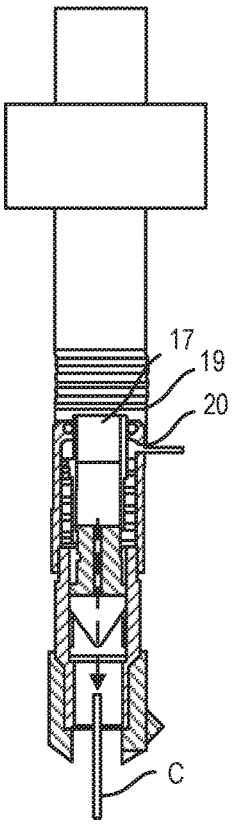

The figures listed below, from 2 to 11 refer to the mechanism in question, reason of this patent application:

FIG. 2—exploded perspective view of all the safety mechanism elements. In brackets are indicated the sets that after coupled between each other, compose the mechanism as a whole. Thus are shown the cable gland, the "Y" connection, the false turning connector and the safety valve;

FIG. 3—Exploded perspective view of the cable gland. As noted, this set consists of a support receiver base with rubber mordant, an actuator surrounded by a spring, anchored on the stop of a sliding plunger by an upper cylindrical jacket, of oil entry. Beside, in 3A it is shown the cable gland assembled;

FIG. 4—exploded perspective view of all "Y" connection elements. As noted, this set consists of an oblique nozzle attached to another fluid hose receiver nozzle, housing a repair for ball valve. Beside, in 4A, it is shown the "Y" connector mounted;

FIG. 5—exploded perspective view of all the false rotating connector elements. As noted, the set that consists of cylindrical body receiver of balls and sealing rings mounted on the neck of a cylindrical base with nozzle. Beside, in 5A, it is shown the false turning connector mounted;

FIG. 6—exploded perspective view of all elements of the safety valve. As noted, this set consists of a glove with ball valve, mounted in the housing of a cylindrical body. Beside, in 6A, it is shown the assembled valve;

FIG. 7—perspective view of the assembled sets, aligned to each other. In 7A it is shown that the sets are already coupled to each other, forming the mechanism;

FIG. 8—perspective view of the mechanism mounted and, beside, cut A-A;

FIG. 9—cut A-A, showing the mechanism already threaded by the safety valve, in the nozzle of the drill string as well as connected by "Y" connection, to the hose of the fluid station (not shown) and to the oil entry of its cable gland, connected to the oil pump. Beside, in Det. A, it is shown that the mechanism has a plunger that will perform under oil pressure. In Det. B it is shown the plunger under oil pressure, when it imposes a pressure by the actuator, in the rubber mordant. In this condition, the mordant is deformed and expands in order to strongly embrace the coupling cable of the token pipe in the bottom of the well;

FIG. 10—cut A-A, showing that, in case of great pressure from the influx, the embrace against the mordant may not be enough to block the flow of gas or oil, where a specific cable cutter cuts the coupling cable. In detail C is shown the coupling cable cut. In det. D is shown the cable going down the drill string with the tube containing the token;

FIG. 11—cut A-A. Shows, in sequence, in detail E the coupling cable after cut. In detail F is shown that the coupling cable exceeded the ball valve hollow that compose the mechanism. In detail G, it is shown that, after triggering by a key, the ball valve was turned positioning transversely its cutout, blocking altogether, by its massive face, the influx, completing the security system. In Detail H, view in another angle in relation to the detail G, showing the ball valve from its hollow body, also in influx blocking condition;

FIG. 12—perspective view showing the additional safety device, aligned between an external rod threaded terminal to the drilling well and to the plunger jacket of the cable gland. Beside, in detail I, it is shown the device section, showing its body in the shape of an internally threaded cup, forming housing with stop for a cradle to accommodate retainers and sealing ring;

FIGS. 13, 14 and 15—show, in sequence, the use of additional safety device. Such device will be used if, after the coupling cable has been cut and has not descended to the well bottom (in influx situations);

FIG. 16—flow chart showing the events for the well closure.

In accordance with the attached drawings, the "SECURITY MECHANISM FOR INSTALLATION IN SOIL DRILLING TOOLS, WITH GAS/OIL LEAKAGE LOCKING SYSTEM IN THE RECOVERY STAGE OF INTERNAL TUBE CONTAINING TOKEN", object of this present application for patent, consist of a mechanism such as that shown in its entirety in FIG. 2, for application in the tooling of a drilling machine.

Figure 3A:
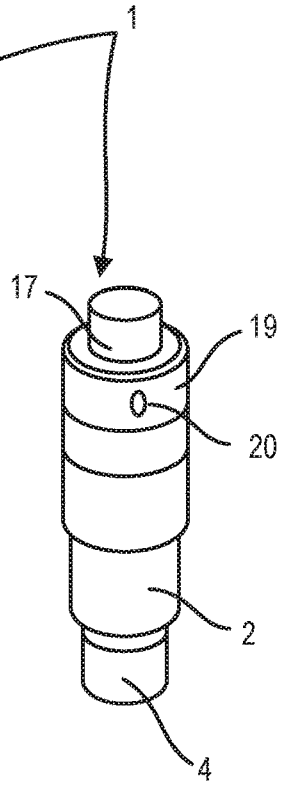

As shown in FIGS. 3 and 3A, the mechanism has a cable gland (1) composed of the base (2) having inner housing (3) with a lower connector recess (4), support receiver (5) with a concave cradle (6) in which it is engaged the conical tip (7) of a deformable mordant (8), made of rubber. Said mordant (8) receives superiorly the support of a bipartite actuator (9) which sides (10) and (11) are joined by means of a ring spring (12).

The base (2) containing the support (5) coupled with the mordant (8) receives the support of one of the helical spring ends (13) surrounding the upper portion of the bipartite actuator (9) and the lower neck (14) of a plunger (15) equipped with stop (16). In this stop (16) the helical spring (13) anchor its opposite end, whereas the upper neck (17) of said plunger (15) passes over the hole (18) of a cylindrical jacket (19) equipped with oil inlet (20).

Figure 4A:
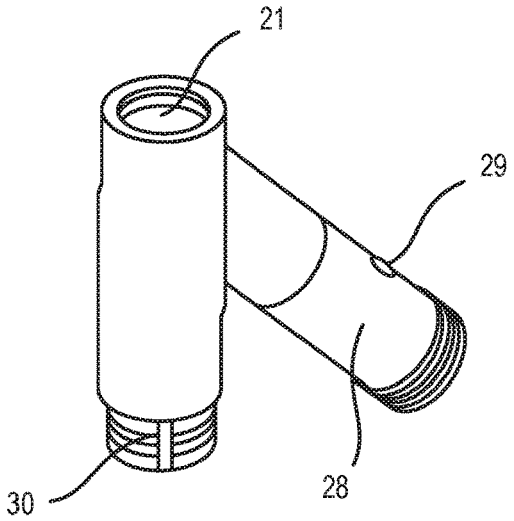
Figure 5A:
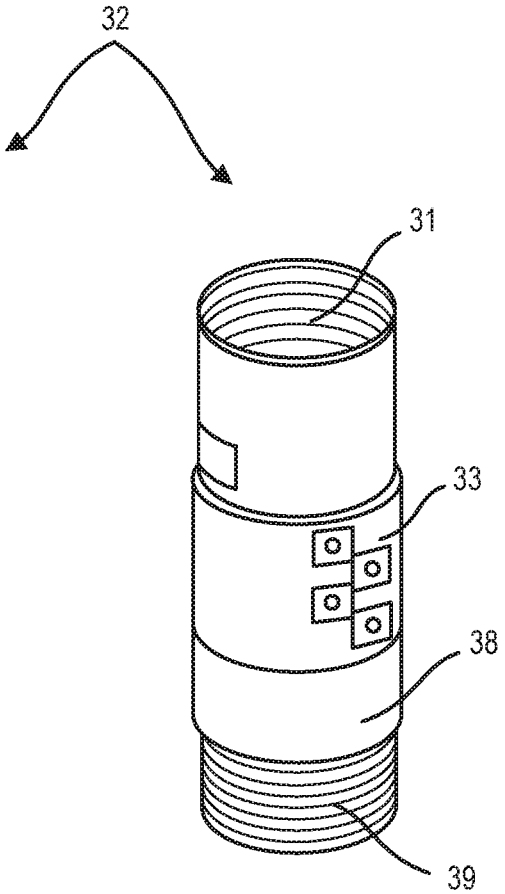

By its connector recess (4) the base (2) receives the upper nozzle coupling (21) of a "Y" connection (22), as shown in FIGS. 4 and 4A, which oblique threaded nozzle (23) is sealed by a repair kit (24) for a hollow ball valve (25) provided with cutout (26) which is aligned to the passage (27) of a glove with threaded nozzle (28), receiver of key (29). By its lower straight nozzle (30) the "Y" connection (22) receives the nozzle (31) of a false spin connector (32), as shown in FIGS. 5 and 5A, in which cylindrical body (33) is housed one ball (34) and sealing rings set (35) which are locked in the grooves (36) of the neck (37) of a cylindrical base (38) with lower nozzle (39).

Figure 6A:
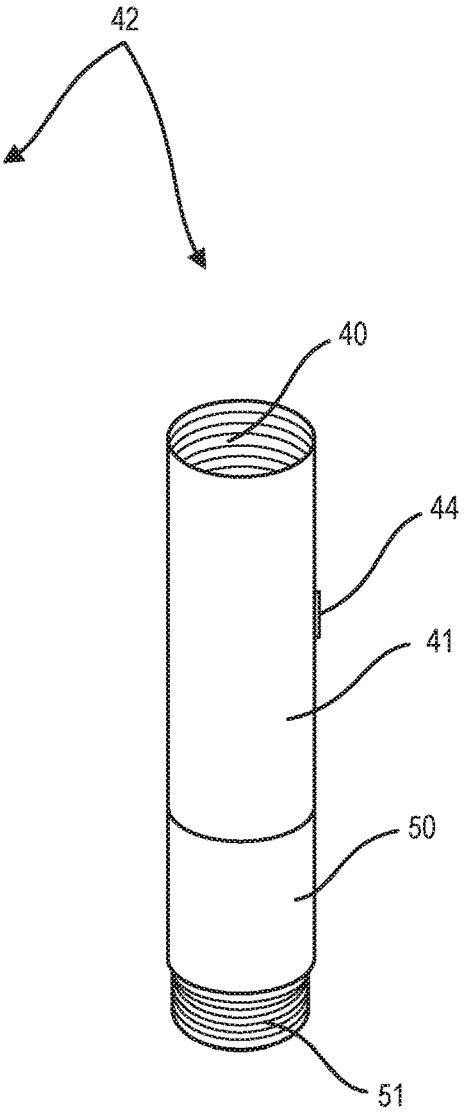

Through the lower nozzle (39), the false spin connector (32) is threaded to the threaded end (40) of the glove (41) of a safety valve (42), as shown in FIGS. 6 and 6A, which is provided with entry (43) for a hexagonal section switch (44) which receives a repair kit (45) for a ball valve of hollow body (46) and provided with cutout (47), said repair (45) mounted in the housing (48) of the threaded neck (49) of a cylindrical body (50) with threaded lower nozzle (51).

Thus constituted the mechanism, as shown in FIGS. 7, 7A, 8 and 8A, the same will be used in soil drilling equipment tooling. Said mechanism, as shown in FIG. 12 will work with an additional safety device (52), also object of this patent application, formed by a cup (53) with internal thread fillets (54) forming a lower cradle (55) with delimiter stop (56) of two retainers (57), in addition to a larger diameter housing (58) for a sealing ring (59), as shown in the detail I and J of FIG. 12.

Thus, after a certain drilling cycle, as previously explained in the state of technique, the token must be extracted requiring its withdrawal through the cable (C) of coupling of the token recovery pipe. At this stage, the chuck (M) opens and releases the last rod (H) introduced in the drilling well. Then, the chuck (M) is displaced from the drilling well and will receive the external rod (H) in which threaded terminal is coupled the additional safety device (52) positioned outside the drilling well. Such a device (52) remains in waiting to be introduced (if necessary) during token extraction, as will be shown later.

Being the last rod (H) of the drilling well introduced (free of the chuck (M)), receives by its head together with the nozzle (B) of the drill string, the lower nozzle threading (51) of the cylindrical body (50) of the valve (42), holding the cable (C) of the tube coupling.

Since it is locked to the false swivel connector (32), the safety valve (42) can be threaded regardless of "Y" connection (22) which, in turn, remains static with the cable gland (1). This false swivel connection (32) is necessary because of the limited space surrounding the nozzle (B) of the drill string, in which it would not be possible the connection "Y" swivel (22) because of its oblique nozzle (23) and therefore of the entire mechanism, which would difficult the installation.

The threaded nozzle (28) of the "Y" connection (22) receives a hose (F), as shown also in FIG. 9, connected to a fluid station controlled by the sensory device (not shown), while the cable gland (1) receives connection of an oil pump (0) (not shown) through the hole (20) of the cylindrical jacket (19).

Thus mounted the mechanism, the same allows in the tooling, when in the inner tube recovery stage containing token, that the coupling cable (C) is released internally by the drill string, going down freely until it reaches said token recovery pipe.

After detected influx by observing the excessive return of drilling fluid through the string nozzle, in a first stage is interrupted the recovery procedure immediately and triggered the oil pump (0), as shown in detail A of FIG. 9 that, through entry (20) fills the gap between the stop (16) and the wall of the cylindrical jacket (19) in the form of an oil chamber, forcing the plunger (15) to press the bipartite actuator (9) and overcome, simultaneously, the force of the helical spring (13). In this condition the bipartite actuator (9) crushes the mordant (8) made of rubber, through seating between a conical tip (7) and a concave cavity (5) of the support (6), has rubber material expanded, causing the adherence "molded" to the coupling cable (C), embracing it strongly, as shown in detail B of FIG. 9.

Once the coupling cable (C) is sealed, the pressure of the injected fluid is increased, controlling the tightness of gas and/or oil underground prevented from escaping through the drill string, without danger of reach the external environment through the nozzle.

If the mordant (8) still does not allow the seal because of great pressure imposed by gas or oil or device wear, as illustrated details C and D of FIG. 10, the coupling cable (C) is cut, passing over the hollow body of the ball valve (46), causing it to descend together with the tube containing the token or not, through the drill string, as shown in the detail E of FIG. 11. This allows the hexagon key (44) of safety valve (42), by the recess (47) to rotate the ball valve (46), as shown in detail F of FIG. 11, which has its hollow body displaced, positioned transversely, as shows details G and H also on the FIG. 11, so that its massive face prevent passage of gas or oil (influx) through the safety valve (42), completing the proposed security system.

If the cable (C) of coupling cut does not descend because it is stuck by the mordant (8) or by flotation of said cable (C) due to the influx pressure from bottom to top inside the drill string, the ball valve enclosure (46) is prevented by said cable (C), being the system still exposed to the leakage (influx). In this condition the chuck (M) is moved to direct the external rod (HE) coupled with the device (52), aligning it with the edge of the cylindrical jacket (19) of the plunger (15) of the cable gland (1). Thus, as shown in the sequence of FIGS. 13, 14 and 15, the chuck (M) goes down and push the device (52) which, through its ring (59) seat around the edge of the jacket (19) and retainers (57) surrounding the plunger (15). With the imposition of force by the chuck (M) the ring (59) and retainers (57) cause additional sealing which allows the relief of mordant pressure (8) by releasing the cable (C) of coupling. When the cable is loose (C), it descends with the barrel to the bottom, allowing close the ball valve (46), shown in FIG. 11.

Thanks to constructiveness of the mechanism (by which in the extraction stage of the token, continuous, the coupling cable (C) receives the sealing system and security in question), the ore drilling tooling that uses barrel, can be installed on the tooling of drilling equipment for oil/gas wells.

With this, a remarkable technical effect occurs in the soil drilling segment as a simple tooling, until then used for ore only, by the new seal and security system now added, through the mechanism in question, enables drilling with much lower cost, of oil/gas wells and additionally safer in usage of tooling derived from mining. Moreover, continuous extraction of token uniformly and without stopping the device enables detailed study of the soil from beginning to the end of the drilling, providing greater precision in analysis and logistics for drilling of oil/gas wells.

Next, as illustrated in the flowchart of FIG. 16 it is listed a series of well closure procedures for the claimed system, recovery of the barrel—inner tube, with the cable gland assembly (1), "Y" connection (22), false swivel connector (32) and safety valve (42). The technical specifications are given in English, used throughout the national territory and, therefore, well kept in this patent application.

Procedure for Well Closure Recovering Inner Tube with Set of Cable Gland, Y Connection and Safety Valve—HARD Method.

1. QHSE 1.1. Bear full PPE to work in the area.

1.2. Performing risk analysis of work when necessary.

1.3. Perform the opening of work permit (PT) when necessary.

1.4. Use seat belts when working at height.

1.5. When observing acts or unsafe conditions, stop work.

1.6. Isolate area when handling cargo, execution of hot work, pressure testing, etc.

1.7. When in doubt running the task, ask for fire safety technician or consult supervision.

2. Knowledge Consolidation on Main Primary Evidence of Kick (Influx)

2.1.Primary Evidence of Influx a) Increase in the return flow: is a primary evidence of influx or the gas already present in the well, and is expanding. The most common type of instrument to detect variations in the return flow consists of a blade installed in the sludge outlet and connected to a spring or potentiometer. When the return flow varies, the tension in spring or potentiometer resistance changes indicating a change in the well return flow. The alarm system connected to the system is triggered if this change exceeds a variation interval of the return flow previously set.

b) Sludge volume increase in the active tank: is a primary evidence of Influx because it indicates that the fluid from the formation is entering the well, if there is no addition of drilling fluid in the tanks of active system or other event that causes volume increase or increase in dynamic level of the active tank.

c) Sharp increase in the penetration rate: is a primary evidence of Influx in Slim Drilling drilling, although changes in the rate of penetration may have other causes, such as weight variations on the drill, the rotation or the flow or changing in formations cut by the drill. In the case of Influx, increased penetration rate is due to the existence of a negative pressure differential acting on the formation being drilled.

d) Well flowing in Flow Check.

3. Definition of the Procedure for Set Utilization

Sequence of operations for well closure in the Hard method, during the recovery of the inner tube with token, with cable operation (Wireline) inside the rods with set of Gland Cable, False Swivel Connector, Y Connection and Safety Valve on the top of the rods.

4. Scenario

Applies at the time of withdrawal of the inner tube using the Wireline cable of the probe and with set of Gland Cable, False Swivel Connector, Y Connection and Safety Valve installed on the string.

5. Status of Drilling Equipment 5.1. Fully enclosed Choke.

5.2. Gland Cable, False Swivel Connector, Y Connection and Safety Valve on top of the last rod wedged in Foot Clamp.

5.3. Kelly rod suspended on the mast with open chuck and in standby to be used at any time.

5.4. Drilling (coring) was stopped, the witness broken with best practice, initiated the procedure to recover the internal tube with Wireline cable.

5.5. Crown or drill out of the bottom.

5.6. There is no rotation in the string.

5.7. There is no pumping of drilling fluid.

5.8. Angler of inner tube and wireline cable inside the rods.

5.9. Trip Tank aligned with the well and monitoring through monitoring spreadsheet.

6. Well Closure Sequence

STEP 1: when detecting influx evidence inside the well, stop token withdrawal via cable.

STEP 2: Close Cable Gland hydraulically using manual hydraulic pump.

STEP 3: Close return valve in the Y connection and replace return hose by fire resistant hose connected to the Stand Pipe Manifold.

STEP 4: close BOP tubes drawer.

STEP 5: Open the HCR valve (High Closing Ratio) of Choke line.

STEP 6: notify supervision team (Company Man and Charged).

STEP 7: confirm the closure of the BOP tubes drawer and lock it manually.

STEP 8: Confirm opening of the HCR valve.

STEP 9: Observe the maximum permissible pressure (LOT) in Choke manometer to prevent the fracturing of the next formation of the surface coating shoe; have at hand updated prior information spreadsheet.

STEP 10: observe the growth of pressures in the Choke (SICP) and inside the string (SIDPP), record the pressures read in well closure spreadsheet every one (1.0) in one (1.0) minute until the moment where it is registered three equal readings, at this time the pressure in the Choke manometer is the SICP and in Stand Pipe Manifold (SPM) is SIDPP.

STEP 11: Record the closing equalized pressure in the Choke (SICP) and SPM (SIDPP).

STEP 12: Fill in the worksheet data for well control.

STEP 13: implement the applicable method of well control as determined by PROVIDER.

Complementary Comments

In the event of fracture of the shoe of surface coating, before or during the application of circulation and control methods of the kick, apply control methods of circulation loss above the kick zone, according to operator recommendation.

Do not allow the loss of mud string inside the rods string, which generates hydrostatic pressure loss greater than 5 psi.

If observed leakage in the Cable Gland during the equalization of pressures period, cut the cable with the aid of hydraulic cable cutter, triggered remotely (security perimeter of 5 m), close Safety Valve located below the False Swivel Connector, making sure that there is no cable in front of the same front, return the chuck to the closed position, connect Rod Kelly to the top of Safety Valve, apply torque with the chuck and open the assembly Safety Valve for pressure monitoring inside the string; following from STEP 10 item 5 of this procedure.

The invention claimed is:

1. A security mechanism for installation in soil drilling tools comprising a cable gland the cable gland comprising a base having an inner housing, with a lower connector recess, the lower connector recess receiving a support having a concave cradle, the concave cradle coupling of a conical tip of a mordant on which rests superiorly a bipartite actuator adjacent the mordant, the bipartite actuator having a first side and a second side joined by a ring spring, said base supporting an end of a helical spring, the helical spring surrounding an upper portion of the bipartite actuator and a lower neck of a plunger, the plunger provided with a stop, an opposite end of said helical spring being anchored to said stop, wherein an upper neck of said plunger passes over a hole of a cylindrical jacket having an oil entry, and at said connector recess the base (2) receives an upper nozzle coupling of a "Y" connection, an oblique nozzle of said "Y" connection is sealed by a first repair seal to a first hollow ball valve, said first hollow ball valve is provided with a first cutout which is aligned to a passage of a first glove with a threaded nozzle, the first cutout having a key receiver, wherein a lower right nozzle of the "Y" connection receives a nozzle of a swivel connector, the swivel connector having a first cylindrical body for housing a ball set and sealing rings, the ball set and sealing rings are locked in grooves of a neck of a second cylindrical body with a bottom nozzle which is threaded to a threaded terminal of a second glove of a safety valve, the second glove provided with an inlet for a key, the second glove receives a second repair seal for a second hollow ball valve and a second cutout, said second repair seal being mounted in a housing of a threaded neck of a third cylindrical body, the third cylindrical body having a threaded lower nozzle.

2. The security mechanism for installation in soil drilling tools according to claim 1, the security mechanism configured for being mounted so as to surround a coupling cable of a token recovery pipe barrel of the soil drilling tools through a lower nozzle of the safety valve at a head of a hose next to a nozzle of the drill string locked in independent threading by the swivel connector to the "Y" connection, which, in turn, receives the hose connected to a fluid station controlled by a sensory device, while the cable gland receives connection of an oil pump through the hole of the cylindrical jacket.

3. The security mechanism for installation in soil drilling tools according to claim 2, wherein for allowing the release of the coupling cable by the tooling drill tools during a recovery stage together with the safety valve (42) followed by lifting of said coupling cable and in a case of influx, stopped the recap operation, be is triggered by the oil pump to fill through the oil entry a gap between formed between the stop and a wall of the cylindrical jacket so that the plunger presses the bipartite actuator overcoming both the force of the helical spring, said bipartite actuator and said mordant and expanding it through the seating of said conical tip in the concave cradle (5) of the support for adherence to the coupling cable.

4. The security mechanism for installation in soil drilling tools according to claim 1, further comprising a cup (53) with internal thread fillets forming a lower cradle with a delimiter stop of two retainers, and a larger diameter housing for a sealing ring forming a device fixed in an external rod threaded terminal to a well bore attached to a chuck.

5. The security mechanism for installation in soil drilling tools according to claim 4, wherein after the adherence of the coupling cable by the mechanism, the pressure of the injected fluid is increased for tightness control of the gas and/or oil underground, preventing it from escaping through the drill string and, the coupling cable is cut down with the token recovery barrels passing over the second hollow ball valve, allowing through the key triggered against the second cutout, the second hollow ball valve is rotated and the second hollow ball valve having a body displaced to transversely position a face for preventing passage of gas or oil by said safety valve (42).

6. The security mechanism for installation in soil drilling tools according to claim 4, in case the cable of coupling cut does not go down by being stuck by the mordant (8) and with the second ball valve prevented, the chuck (M) is moved directing an external rod (HE) being coupled with the device for seating of a ring around an edge of the cylindrical jacket and engagement of the plunger by retainers forming auxiliary sealing for the mordant so as to release the cable of coupling for the closure of second hollow ball valve.

7. The security mechanism for installation in soil drilling tools according to claim 1, wherein, through the mechanism the soil drilling tools can be used, for continuous token extraction in the survey of oil or gas wells.

* * * * *